United States Patent [19]

Reiner et al.

[11] 4,008,895

[45] Feb. 22, 1977

[54] MAZE GAME

[75] Inventors: Lawrence L. Reiner, Woodbury, N.Y.; John P. McNett, Short Hills, N.J.

[73] Assignee: Lawrence L. Reiner, Woodbury, N.Y.

[22] Filed: Sept. 15, 1975

[21] Appl. No.: 613,256

[52] U.S. Cl. ..... 273/113; 273/153 R

[51] Int. Cl.[2] ..... A63F 7/04

[58] Field of Search ..... 273/109, 113, 115, 153 R; 46/24, 30

[56] References Cited

UNITED STATES PATENTS

| | | | |
|---|---|---|---|
| 669,452 | 3/1901 | Ashby et al. | 273/113 |
| 3,358,997 | 12/1967 | Belz | 273/120 R X |
| 3,392,981 | 7/1968 | Robertson | 273/121 A X |
| 3,811,683 | 5/1974 | Street | 273/157 R |
| 3,827,694 | 8/1974 | Lemelson | 273/113 |

FOREIGN PATENTS OR APPLICATIONS

| | | | |
|---|---|---|---|
| 459,015 | 8/1913 | France | 46/30 |

*Primary Examiner*—Anton O. Oechsle
*Attorney, Agent, or Firm*—Edward F. Levy

[57] ABSTRACT

A maze has two opposing substantially coextensive walls one of which forms an inner three-dimensional form or shell and the other which forms an outer form or shell. Each of the shells is generally in the form of a cube and the inner shell is fixedly positioned within the outer shell so as to maintain a predetermined, uniform distance between the inner and outer walls. The outer wall is formed with a network of channels which, together with the inner wall, define a corresponding network of passageways. The passageways on each side of the outer cube are connected to the passageways on the adjacent sides of the cube so as to form interconnected passageways which permit one or more marbles, for example, to move through the passageways on one or more sides of the cube with changes in orientation of the maze in space. Apertures are provided in at least one passageway on each side of the cube for providing points of entry and exit for the marbles into and out of the maze. By selective changes in orientation of the maze in space marbles within the maze can be made to move through the passageways without escaping through the apertures.

15 Claims, 7 Drawing Figures

MAZE GAME

BACKGROUND OF THE INVENTION

The present invention generally relates to games and toys, and more specifically to a three-dimensional maze game of skill and chance.

Numerous maze games are known which require various degrees of skill and chance in order to move an object, such as a marble, from one point in the maze to another. Many of the known mazes are in the form of tortuous channels or passageways in two-dimensional space which may include blocking means or dead ends to make it more difficult to move the marbles from a starting to a finishing point. Other known mazes have an aperture for inserting a marble, for example, thereinto. The skill required with the latter type of maze resides in the ability to remove the marble from the maze by selective changes in orientation of the maze. As with the first described mazes, the mazes under discussion are also formed in two-dimensional planes. For this reason, while skill is required for bringing the marbles out of the maze, the marbles can be observed within the planar maze and the same may be suitably oriented to advance the marbles through the tortuous channels of the maze in a desired manner.

SUMMARY OF THE INVENTION

It is an object of the present invention to provide a more challenging maze game by providing a three-dimensional form which includes surface channels or passageways for permitting one or more marbles to move therethrough with the changes in orientation of the maze.

It is another object of the present invention to provide a three-dimensional maze generally in the shape of a polyhedron, having a plurality of sides. Each of the sides include passageways which are interconnected to each other as well as to passageways on adjacent sides to thereby permit movement of objects, such as marbles, along one surface or between adjacent surfaces of the polyhedron.

It is still another object of the present invention to provide a maze game whose orientation can be changed in three-dimensional space, selective ones of the passageways being provided with apertures for providing points of entry and exit for the marbles into and out of the network of passageways.

It is yet another object of the present invention to provide a maze game as in the last object, which requires skill in retaining the marbles which are within the maze from escaping through the apertures as the maze is reoriented in space and the marbles are permitted to freely move through the interconnected passageways.

It is an additional object of the present invention to provide a three-dimensional maze game which is simple in construction and economical to manufacture.

It is a further object of the present invention to provide a maze game which is in the general form of a polyhedron, having a plurality of sides, and which requires observation of each of the individual sides prior to reorienting the maze in order to anticipate the likely movements of the marbles within the passageways in order to minimize the number of marbles which escape out of the maze through the apertures.

In order to achieve the above objects, as well as others which will become apparent hereafter, the maze game in accordance with the present invention comprises a plurality of co-planar networks of substantially closed connected passageways, the walls forming the passageways of each of said co-planar networks generally defining a side of a polyhedron, said passageways providing paths for the passage therethrough of an object, such as a marble. Selected passageways forming each side are in communication with associated passageways on adjacent sides of the polyhedron. The walls of said passageways on at least one side are provided with aperture means for providing a path into and out of said passageways on the respective side. In this manner, movements of the marbles between connected passageways on a single side or between two adjacent sides and escape of the marbles through said aperture means may be affected by changes in orientations of the maze.

DESCRIPTION OF THE PREFERRED EMBODIMENTS

Figure 1:
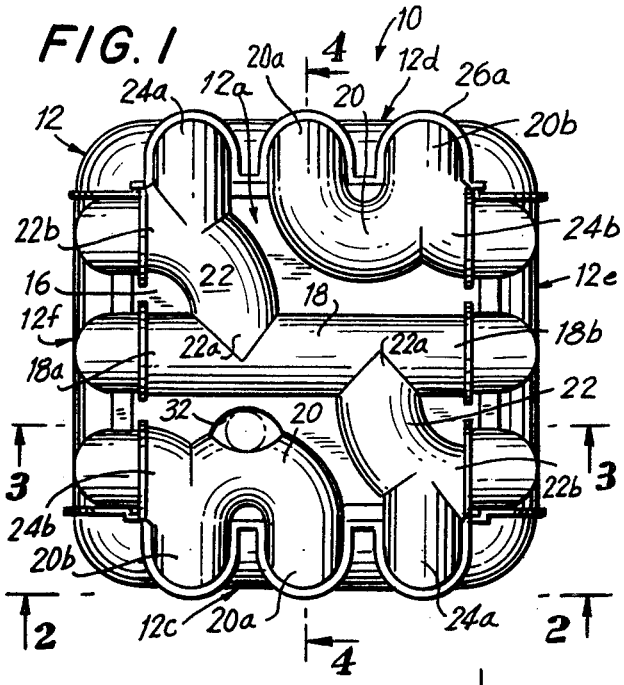
FIG. 1 is a top planar view of the maze game in accordance with the present invention.
Figure 2:
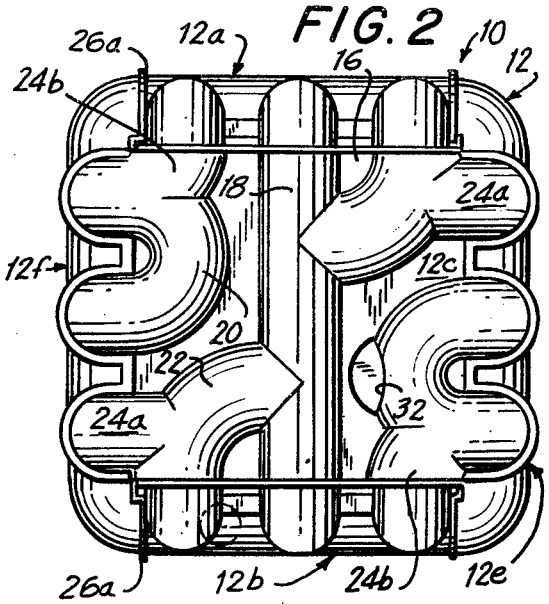
FIG. 2 is a front elevational view of the maze game, taken along line 2—2 of FIG. 1.

Referring now specifically to the figures, in which the identical or similar parts are designated by the same reference numerals throughout, and first referring to FIGS. 1 and 2, the maze game in accordance with the present invention is generally designated by reference numeral 10.

The presently preferred embodiment of the maze game 10 to be described, is in the form of a cube having six sides as follows: top side 12*a*, bottom side 12*b*, front size 12*c*, rear side 12*d*, right side 12*e* and left side 12*f*. However, these designations making reference to directions are only for purposes of facilitating the description that follows.

While the presently preferred embodiment is cube-shaped, it will become apparent that the principle of the present invention is not limited to cubes but that the maze of the present invention may assume other three-dimensional shapes. Advantageously, the three-dimensional shapes are in the form of polyhedrons having a plurality of connected adjacent planar surfaces. However, spherical or other curved three-dimensional forms may similarly be used.

Figure 3:
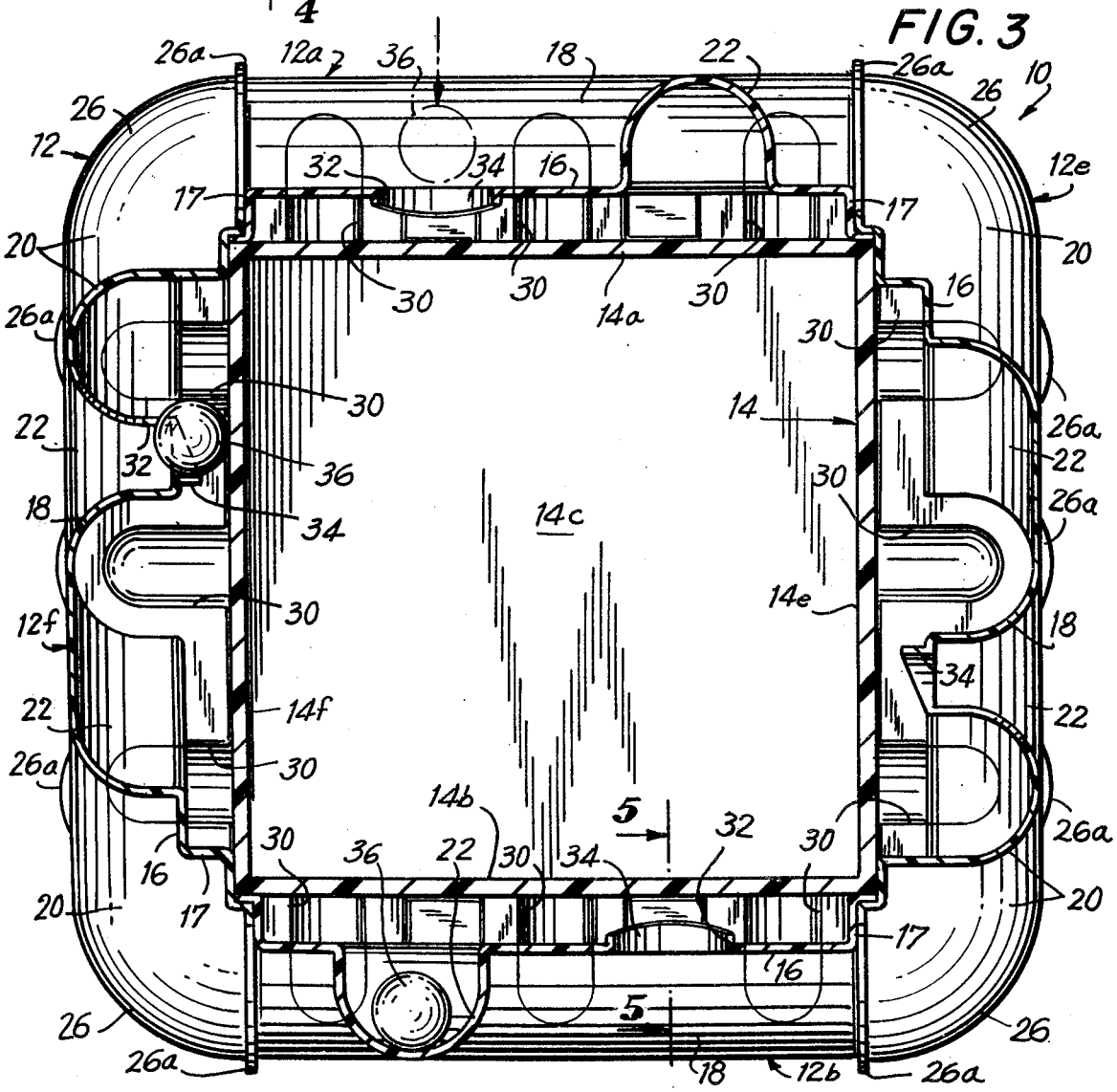
FIG. 3 is an enlarged cross-sectional view of the maze game, taken along line 3—3 of FIG. 1.
Figure 4:
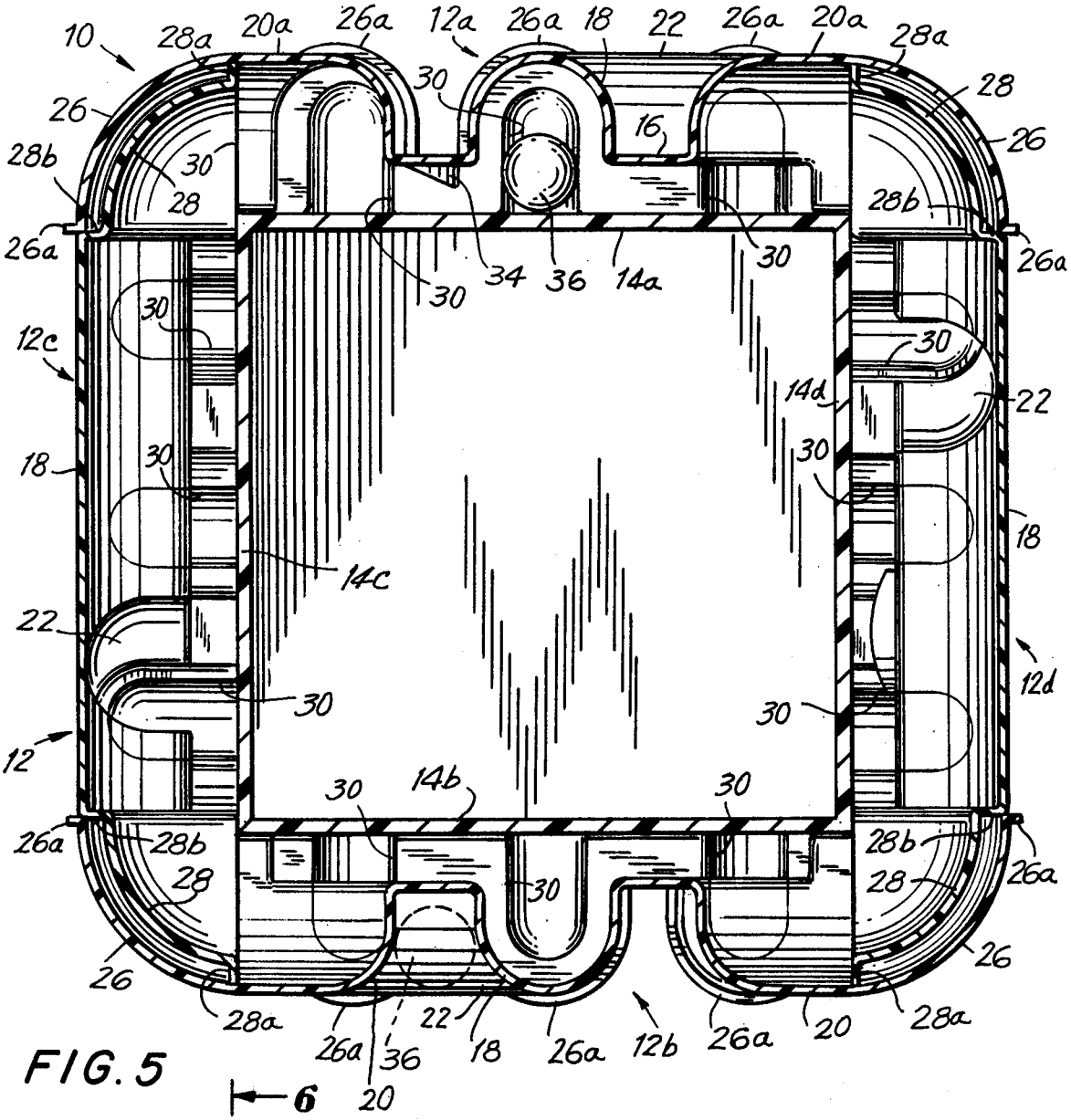
FIG. 4 is a cross-sectional view of the maze game, taken along line 4—4 of FIG. 1.
Figure 5:
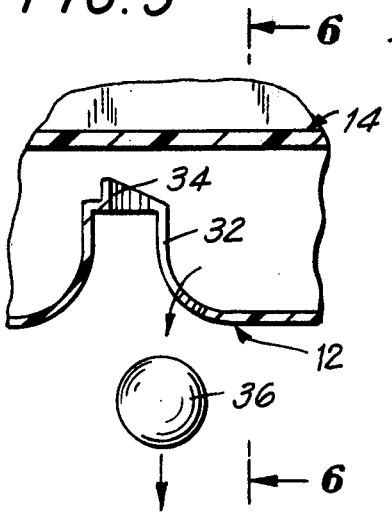
FIG. 5 is a fragmented cross-sectional view of the maze game, taken along line 5—5 of FIG. 3, showing the details of the apertures provided in the walls of the passageways.
Figure 6:
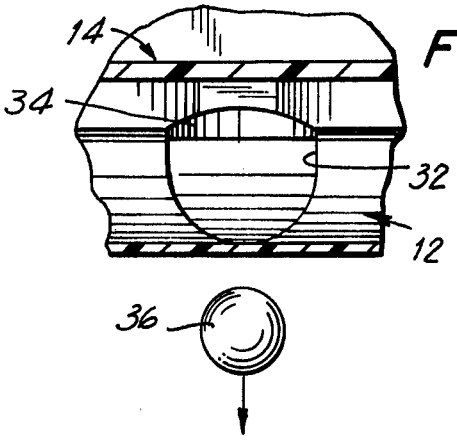
FIG. 6 is a cross-sectional view of the apertures, taken along line 6—6 of FIG. 5.

Referring to FIGS. 3 and 4, the maze game 10 includes an outside or exterior wall 12 which is composed of the above-described sides 12*a*—12*f*. The wall 12 accordingly defines an external three-dimensional form or shell. Disposed interiorly of the external wall 12 is an internal wall 14 which is also configurated in the shape of a cube and has surfaces 14*a*—14*f*, each of which is co-extensive to and opposes a corresponding surface of the external shell 12. The wall 14 accordingly also defines a three-dimensional form or shell which is, however, smaller and disposed within the larger shell 12.

As will be readily ascertained from FIGS. 3 and 4, each of the sides 14*a*—14*f* is flat or planar. On the other hand, making reference to all of the figures, each of the sides 12*a*–12*f* is formed with a network of elongated channels which project in a direction away from the corresponding walls of the inner shell 14 to form, with the shell 14, a corresponding network of passageways to be described.

The flat portions 16 of the sides of the outer shell which are not formed into the channels are spaced from the corresponding opposing surfaces of the inner shell a predetermined distance. The spacing between the flat wall portions 16 of the outer shell and the corresponding surfaces of the inner shell is not critical and may even be reduced to zero. The predetermined distance is maintained at a relatively fixed value by provision of skirts 17 which project inwardly from the flat wall portions towards the direction of the inner shell and abutt against the latter as shown in FIG. 3.

The presently preferred embodiment of the maze game 10 is particularly simple in construction and economical to manufacture because each of the six sides 12*a*–12*f* of the exterior shell or form 12 comprises a similarly molded section or panel. Accordingly, only one mold die must be made and the sections may be made, for example, by vacuum forming, as will become evident hereafter.

With the flat portions or walls 16 as a reference level, each of the molded sections or panels 12*a*–*12f* forming the respective sides of the exterior of the maze game cube is provided with a series of channels which project from the flat portions 16 in an upward direction or in a direction away from the opposing inner walls of the inner shell 14. As best shown in FIGS. 3 and 4, the upwardly projecting channels have transverse cross-sectional configurations substantially corresponding to semi-circles and, accordingly, the channels in each of the sides 12*a*–12*f* form or define generally inverted U-shaped channels which extend generally in planes parallel to the opposing corresponding sides or walls 14*a*–14*f*. Each of the channels, to be described, therefore opposes and cooperates with an associated opposing side or wall 14*a*–14*f* to together define a substantially closed passageway for the movement therethrough of objects such as marbles. It should be clear that by selecting the predetermined uniform spacing between the flat wall portions 16 and the sides 14*a*–14*f* to be equal to less than the diameter of the marbles, the marbles cannot enter the space between the inner shell 14 and the flat wall portions 16 and the marbles are accordingly limited in their movements to those passageways defined by the upwardly projecting channels which effectively increase the spacing between the outer and the inner shells 12, 14 respectively to a value sufficiently greater than the diameter of the marbles to permit free movement of the marbles through the passageways.

An exemplary arrangement of channels and, therefore, passageways will now be described in connection with the presently preferred embodiment. However, it should be recognized that the particular arrangement or configuration of channels or passageways is not in and of itself critical for the purposes of the present invention, and that any other suitable or desired arrangement of interconnected channels may similarly be utilized without departing from the spirit and scope of the present invention.

Since each of the panels or sides 12*a*–12*f* are similarly molded and therefore are similar in every material respect, only the top side or panel 12*a* will be described in full detail, it being understood that the same description of parts or portions is equally applicable to the balance of the sides or panels 12*b*–12*f*. The top side or panel 12*a* includes an elongate generally central, straight channel 18 which extends between a pair of opposing edges of the panel. The channel 18 includes free ends 18*a* and 18*b* proximate to the respective opposing edges of the panel 12*a*.

A pair of channels 20, each in the form of a semicircle, are formed in the panel 12*a* as shown in FIG. 1. The two semi-circular channels 20 are provided on opposing sides of the straight channel 18 and are spaced from each other along the channel 18 as shown, each of the semi-circular channels 20 having free ends 20*a* and 20*b*, the free ends of each circular channel being proximate to a common associated edge of the panel 12*a*. When the semi-circular channels 20 are spaced from each other along the direction of the channel 18 as described above, the free end 20*a* of each semi-circular channel is substantially centrally disposed along its associated edge.

There is also provided a pair of quadrant sections or channels 22 as shown, each of the quadrant channels being connected at ends 22*a* to spaced portions of the straight channel 18 as shown and having free ends 22*b* which terminate proximate the same opposing edges of the panel 12*a* at which the straight channel 18 terminates.

For the above-described straight, semi-circular and quadrant channels, there results two free ends on each edge of the side wall or panel 12*a*. To provide three such free ends along each edge of the panel 12*a*, there are provided opposing branches 24*a* which enamate from a quadrant 22 proximate to the free ends 22*b* and which terminate at the same edges of the panel at which the free ends 20*a* and 20*b* terminate. Additionally, there are provided two branches 24*b* each of which emanates from the semi-circular channels 20 proximate to the free end 20*b*, and the branches 24*b* terminate at those edges of the panel 12*a* at which the straight channel 18 terminates. With this arrangement of channels, including straight and curved or arcuate channels, there are provided three substantially equally spaced channel portions or free ends terminating at each edge of the panel 12*a* as is clearly shown in the drawings.

An important feature of the present invention which substantially facilitates the assembly of the maze game 10 once the individual panels 12*a*–12*f*, have ben molded or formed, is the provision of corner portions at each of the abovedescribed channel free ends, which corner portions are dimensioned and adapted to snappingly engage with one another so as to eliminate the need of additional connecting means for joining the panels or walls 12*a*–12*f* to each other. As best shown in FIG. 4, there are provided two differently sized corner portions, namely wide corner portions 26 and narrow corner portions 28. The wide corner portions 26 are extensions of the respective channel free ends, as to be described, and define ninety degree bends in the connected channels to permit the marbles, for example, to move between associated channels formed on opposite sides 12*a*–12*f* of the maze by being deflected by ninety degrees during such transition of sides.

Each of the wide corner portions 26 forms an extension of a free end of selected ones of said channel free ends as to be described, and terminates in a peripheral flange or lip 26*a*. Similarly, each narrow corner portion 28 defines a similarly configurated structure similar to the wide corner portions 26, with the exception that the narrow corner portions 28 are somewhat narrower and shorter to thereby be fully receivable within associated wide corner portions 26. The narrow corner portions 28 similarly form extensions of selected ones of the passage free ends, as to be described. Since the cross-sectional configurations and dimensions of all the channels are similar, the dimensions of the narrow corner portions 28 are reduced in size by the provision of an inwardly projecting annular step 28*b*. The narrow corner portions are similarly provided with annular lips or flanges 28*a* which are generally similarly dimensioned to the steps 28*b* to provide securing and locking engagement of the narrow corner portions 28 within the wide corner portions 26 and to prevent excessive play between the connected section.

Again making reference to FIGS. 1 and 2, it is pointed out that in the presently preferred embodiment only the free ends 20*a*, 20*b* and 24*a* are provided with wide corner portions 26 while the free ends 18*a*, 22*b* and 24*b* are provided with narrow corner portions 28. Accordingly, the panel 12*a* is provided with narrow corner portions at one pair of free edges thereof while the other pair of free edges thereof is provided with wide corner portions. During assembly of the maze 10, the panels 12*a*–12*f* are arranged to bring at each edge where two panels meet a pair of three wide corner portions 26 on one panel and three narrow corner portions 28 on the adjacent panel. In this manner, the narrow corner portions 26 may be received within the wide corner portions to effect a locking engagement as suggested in FIG. 4. In effect, there results an interlocking arrangement when all the panels have been assembled with each panel itself holding or retaining in place one pair of adjacent panels while itself being held in place by another pair of adjacent panels. For example, referring to FIG. 1, , the panel 12*a* receives the narrow corner portions 28 of the front and rear sides or panels 12*c*, 12*d* and, accordingly, fixedly secures these panels from outward movement. On the other hand, the same top wall 12*a* has the narrow corner portions thereof received by the wide corner portions of the sides or panels 12*e* and 12*f*, which panels secure the position of the panels 12*a*.

During assembly of the maze game 10, five of the panels may be assembled as above described so as to bring the associated wide and narrow corner portions into engagement as above suggested to form a cube having one side thereof opened. The inner cube or shell 14 may, at this time be inserted through the open side of the cube. The sixth external side or panel of the outer shell 12 is now caused to engage the four adjacent sides to bring the narrow and wide corner portions at each edge thereof into the cooperative engagement as described above. To do so, it may be necessary to somewhat deform or flex the sixth panel somewhat to permit such engagement. Upon such deformation of the panel, the sixth panel may be snappingly assembled with the four associated adjacent panels to form a stable outer shell 12. It will be appreciated that the provision of identical panels in this manner and the ease of connection of these panels to each other permits economical manufacture of this game.

Each of the narrow corner portions 28 defines an opening 30, as best shown in FIGS. 3 and 4. Clearly, since three wide and three narrow corner portions are provided at each edge where two panels meet, there will be provided three openings 30 at each such edge. The dimensions of the openings 30 are selected to permit free passage or movement therethrough of objects to be used during the game, such as marbles 36. In this manner, a marble 36 may readily move from the channels on one side of the maze game 10 to another side thereof by being deflected ninety degrees through one pair of corner portions.

There is advantageously provided at least one opening or aperture 32 on each panel 12*a*–12*f*, which opening or aperture is formed partially within a channel and partially within a flat portion 16. The dimension of the opening 32 is selected to permit passage of a marble 36 therethrough. Advantageously, there is provided a tab portion 34 which partially bounds the periphery of an associated aperture 32 which is formed in the flat wall portion 16 and which tab projects in the direction of the inner shell 14. The tabs 34 form ledges between the inner and outer shells 12, 14 to facilitate escape of a marble 36 through a respective aperture 32 when the marble moves into position to come to rest on the tab portion 34, as shown by way of illustration on the left side wall 12*f* in FIG. 3. The provision of the tab portion 34 eliminates any possible retaining action which the peripheral edge formed in the flat portion 16 may have on small marbles the radius of which is equal to or smaller than the predetermined spacing between the flat wall portions and the inner shell 14.

While not shown, the present invention also contemplates the use of blocking means, such as transverse walls formed in selected channels described above. Such blocking means may be used as in conventional maze games to prevent free passage of marbles, for example, through the associated passageways. Such blocking means adds another dimension or element of uncertainty in the playing of the game and, accordingly, makes the game that much more interesting.

The materials out of which the inner and outer shells 14, 12 are made are not critical for the purposes of the present invention. In the presently preferred embodiment, the inner shell 14 may be made out of any suitable material such as cardboard, synthetic elastomeric materials, or the like. On the other hand, since the outer shell 12 is advantageously molded, it is preferable and most economical to make the outer shell out of a synthetic plastic material. It is also preferred that the plastic material used for the outer shell be transparent to permit observation of the marbles which are disposed within the maze 10. When the outer shell 12 is made of a transparent, preferably clear material, the outer surfaces of the inner shell 14 may advantageously be provided with decorative designs which thereby becomes visible through the outer shell.

While only one opening or aperture 32 is provided in each face of the outer shell 12, it should be clear that two or more openings may be provided. Additionally, it should be clear that the walls 14*a*–14*f* of the inner shell 14 need not be planar as shown and described. It is only important that the inner shell wall and the outer shell wall together cooperate to form the above-discussed passageways which permits free passage of marbles therethrough. Thus, the inner shell 14 may similarly be formed with inwardly projecting channels which project in directions away from the corresponding or opposite outer panels 12*a*–12*f* to form complementary halves of the passageways. Accordingly, it should be clear that that the opposing walls of the inner and outer shells may cooperate to form transverse cross sections having different configurations, including circular, semi-circular, triangular, square and the like. The actual transverse cross-sectional configuration is not critical, it only being important that the passageways permit free movement of objects therethrough such as marbles 36. In this connection, it should be pointed out that the projections can be reversed with respect to the inner and outer shells. Thus, it is possible to provide the outer shell with planar surfaces while inwardly directed channels are formed on the inner shell to produce oppositely directed passageways.

In the presently preferred embodiment, each side of the cube-shaped maze 10 is provided with a network of interconnected channels or passageways through which objects, such as marbles may move. By using a transparent outer shell, all the marbles contained within the maze may be readily observed prior to reorientation of the maze.

Figure 7:
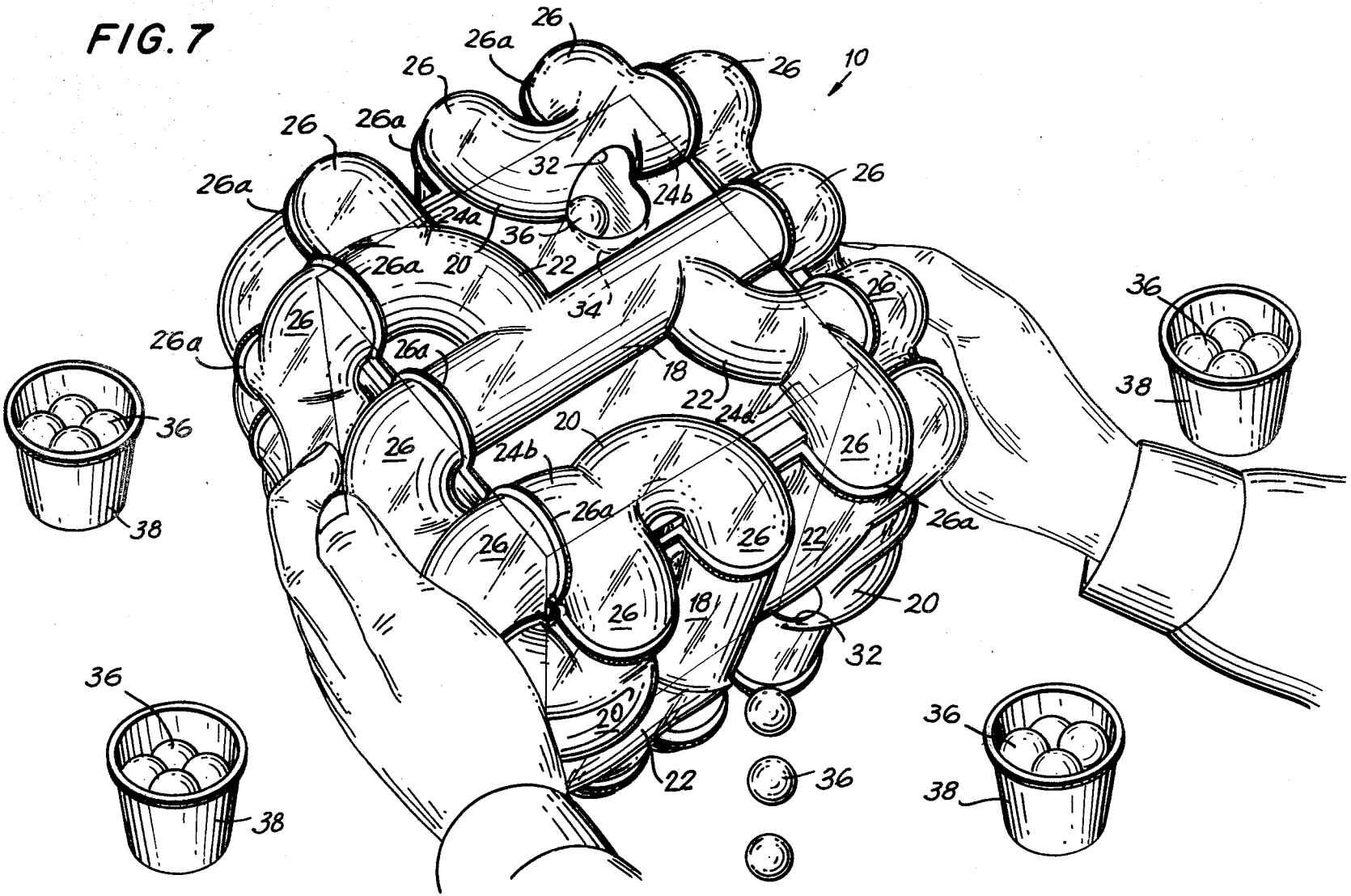
FIG. 7 is a perspective view of the maze game shown in FIG. 1, showing the manner in which the maze may be handled during play and illustrating the cups containing the marbles, each of which may correspond to a different player.

In FIG. 7, the maze 10 is shown during play. After the marbles have been observed within the maze, a decision is made as to how to reorient the same, for example, in a ninety degree turn, in order to avoid escape of marbles from the maze or to minimize such escape. In accordance with one possible set of rules for this game, two or more players are each initially provided with a predetermined number of marbles which may be housed within cups 38. Each player inserts a marble through one of the apertures 32 and subsequently reorients or turns the maze through 90°. If no marbles come out during such reorientation, the next player inserts a marble and similarly reorients the maze. Upon reorienting the maze, each player retains all the marbles which have escaped during such reorientation. The first player to dispose of all his marbles and therefore be left with zero marbles, subsequent to reorienting the maze, is the winner. Clearly, the object or the skill of the game is to observe the positions of the marbles in the respective channels and attempt to predict how the maze could be reoriented to prevent escape of the marbles through the apertures 32.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. Maze game comprising a plurality of interconnected exterior walls forming a first three dimensional body of polyhedron shape, a plurality of interconnected interior walls forming a second, similarly-shaped three dimensional body of smaller size than said first three dimensional body and disposed within the latter, said interior and exterior walls having planar surfaces forming similar polyhedrons, with the planar surfaces of said interior walls underlying the planar surfaces of the exterior walls and being disposed parallel thereto to define a uniform spacing between said surfaces, each of said exterior walls being formed with a network of elongated channels projecting outwardly of the planar surface thereof and in a direction away from the underlying interior wall, said channels forming with said interior walls a corresponding network of passageways, whereby an object having dimensions greater than that of said uniform spacing can move only along paths defined by said passageways, each of said channels having end portions extending beyond the edges of the exterior wall containing said channel and formed with a corner portion having an angular bend, the corner portions of each of said exterior walls being connected in communication with the corner portions of adjacent exterior walls, whereby the passageways in each exterior wall are continuous with the passageways in each adjacent exterior wall and whereby objects within said network of passageways may move from the passageways in one exterior wall to the passageways in another exterior wall when said maze is turned to move successive exterior walls to uppermost horizontal positions, selected ones of said passageways of each exterior wall being provided with apertures for providing points of entry and exit for objects into and out of said network of passageways, whereby objects within said network of pasageways may move through said passageways and escape through said apertures to the exterior of said maze when said maze is selectively turned to change the orientation of said exterior walls.

2. Maze game according to claim 1 wherein each of said channels is of semi-circular cross-section and of inverted U-shape.

3. Maze game according to claim 1 wherein said first and second three-dimensional bodies are cube-shaped.

4. Maze game according to claim 1 wherein said network of passageways includes straight passageways.

5. Maze game according to claim 1 wherein said network of connected passageways includes curved passageways.

6. Maze game according to claim 1 wherein said exterior walls comprise identical panels molded with an identical network of projecting channels.

7. Maze game according to claim 6 wherein the network of channels in each of said exterior walls includes a straight channel extending between opposed edges of said exterior wall and terminating at each end in a corner portion, and a plurality of curved channels each terminating in at least one corner portion, a plurality of said curved channels communicating with said straight channel.

8. Maze game according to claim 7 in which said exterior walls are interconnected with the corner portions of the straight channel of each exterior wall communicating with the corner portions of curved channels of the adjacent exterior walls.

9. Maze game according to claim 8 wherein said first and second three dimensional bodies are cube-shaped and said corner portions have right angle bends.

10. Maze game according to claim 9 wherein each edge of each exterior wall has an equal number of channel corner portions spaced evenly from each other.

11. Maze game according to claim 10 wherein the corner portions at two opposed edges of each exterior wall are of larger size than the corner portions at the other two opposed edges of said exterior wall, said larger corner portions of each exterior wall being dimensioned to receive therewithin the smaller corner portions of the adjacent exterior walls to provide a connecting path between the associated passageways of said exterior walls.

12. Maze game according to claim 11 wherein said corner portions are so arranged about the periphery of each exterior wall to permit said larger and smaller corner portions to be snap fitted when all said exterior walls are interconnected, whereby said exterior walls are arranged in polyhedron shape by the engaging action of said corner portions.

13. Maze game according to claim 1 wherein exterior walls are provided with tab portions partially bounding the peripheries of each of the apertures formed in the passageways thereof, each of said tab portions projecting in the direction of the underlying inner wall to form a ledge between said walls to facilitate escape of an object through the associated aperture when the object moves into registry with said aperture and rests on said tab portion.

14. Maze game according to claim 1 wherein said exterior walls are made of a transparent material, whereby the object within said channels can be observed.

15. Maze game comprising a plurality of exterior walls having planar surfaces forming a first cube-shaped body, a plurality of interconnected interior walls forming a second cube-shaped body of smaller size than said first cube-shaped body and disposed within the latter with said interior walls underlying the planar surfaces of said exterior walls and being uniformly spaced therefrom, each of said exterior walls being molded of a transparent plastic material and being formed with a network of coplanar channels projecting from said planar surface and forming with said underlying inner wall a network of enclosed connected passageways for the passage therethrough of a ball of greater diameter than the uniform spacing between said interior and exterior walls, at least some of said channels extending to the respective edges of said exterior walls and terminating in corner portions projecting beyond said edges and having right angle bends therein, the corner portions of said exterior wall registering with the corner portions of each adjacent exterior wall and communicating therewith to interconnect the network of passageways at each side of said first cube-shaped body with the network of passageways at adjacent sides of said body, at least one of the channels on each exterior wall having an aperture sized to permit passage of said ball out of said channel, whereby movement of said ball between passageways one side of said cube and between passageways on two adjacent sides of said cube, and escape of said ball through said apertures, may be effected by changes in orientations of said maze.

* * * * *